United States Patent [19]

Brodner et al.

[11] Patent Number: 5,046,970

[45] Date of Patent: Sep. 10, 1991

[54] LAMP SOCKET ASSEMBLY

[75] Inventors: Marie T. Brodner, Indianapolis; Jon T. Gale, Anderson, both of Ind.; Donald C. Paul, Downers Grove; Joseph A. Bettini, Naperville, both of Ill.

[73] Assignees: General Motors Corporation, Detroit, Mich.; Tricon Industries, Inc., Downers Grove, Ill.

[21] Appl. No.: 407,982

[22] Filed: Sep. 15, 1989

[51] Int. Cl.[5] ..... H01R 13/00

[52] U.S. Cl. ..... 439/699

[58] Field of Search ..... 439/56, 58, 699

[56] References Cited

U.S. PATENT DOCUMENTS

| | | | |
|---|---|---|---|
| 2,776,415 | 1/1957 | McGinley | 439/58 |
| 2,982,939 | 5/1961 | Kirk | 439/56 |
| 4,152,622 | 5/1979 | Fitzgerald | 439/56 |

*Primary Examiner*—Joseph H. McGlynn
*Attorney, Agent, or Firm*—Edward J. Biskup

[57] ABSTRACT

A lamp socket assembly for a wedge-type lamp bulb having latch means for the lamp bulb that is a separate part of the assembly and is insertable from the base of the lamp socket.

3 Claims, 2 Drawing Sheets

LAMP SOCKET ASSEMBLY

This invention concerns lamp sockets for a snap-in wedge-type lamp bulb and more particularly concerns a lamp socket that is integrally molded with a mounting portion which serves to encapsulate lead connectors that are adapted to be electrically connected to the feed and ground terminals of the lamp socket.

More specifically, the present invention concerns a lamp socket assembly having a tubular base portion adapted to be integrally molded with a ground terminal and a feed terminal for electrical engagement with the contacts of a snap-in wedge-type lamp bulb. The tubular portion is made of a plastic material and has a pair of openings formed in the lower part of the base portion. An insert which includes a pair of spring arms is insertable into the openings formed in the tubular portion and serves to provide a latch means for retaining the wedge-type bulb within the tubular base. In the preferred form, the insert includes a support plate which is integrally formed with the lower part of each of the spring arms so when the latter are inserted into the openings within the tubular portion base, the support plate serves as a stop and is secured to the lower end of the tubular portion. In addition, a plastic mounting portion is formed about the tubular portion and serves to encapsulate the connectors which lead to the ground terminal and the feed terminal and also serves to rigidly secure the support plate to the tubular portion.

The objects of the present invention are to provide a lamp socket assembly for a wedge-type bulb having latch means for the lamp bulb that is a separate part of the assembly and is insertable into the base of the lamp socket assembly; to provide a new and improved lamp socket assembly which includes lead connectors that are encapsulated in plastic and connected to an integrally formed socket member which has a pair of insertable spring arms for retaining a wedge-type lamp bulb within the socket member; to provide a new and improved lamp socket assembly having a plastic tubular portion provided with opening means at a lower portion thereof through which a pair of spring arms are insertable and serve as latch means for retaining a wedge-type lamp bulb within the tubular portion; to provide a new and improved lamp socket assembly which is formed from a plastic material having a heat resistance tolerance of a predetermined level and includes an insertable spring arm arrangement having a heat resistance tolerance of a level higher than said predetermined level; and to provide a new and improved lamp socket assembly having ground and feed terminals that are encapsulated within and form a part of a molded plastic tubular portion into which a pair of plastic lamp bulb retainers are insertable and which is supported by a plastic mounting portion formed around the lead connectors of the ground and feed terminals and a support portion of the retainers.

Other objects and advantages of the present invention will be more apparent from the following detailed description when taken with the drawings in which FIG. 1 is a plan view of a socket assembly made in accordance with the present invention;

Figure 1:
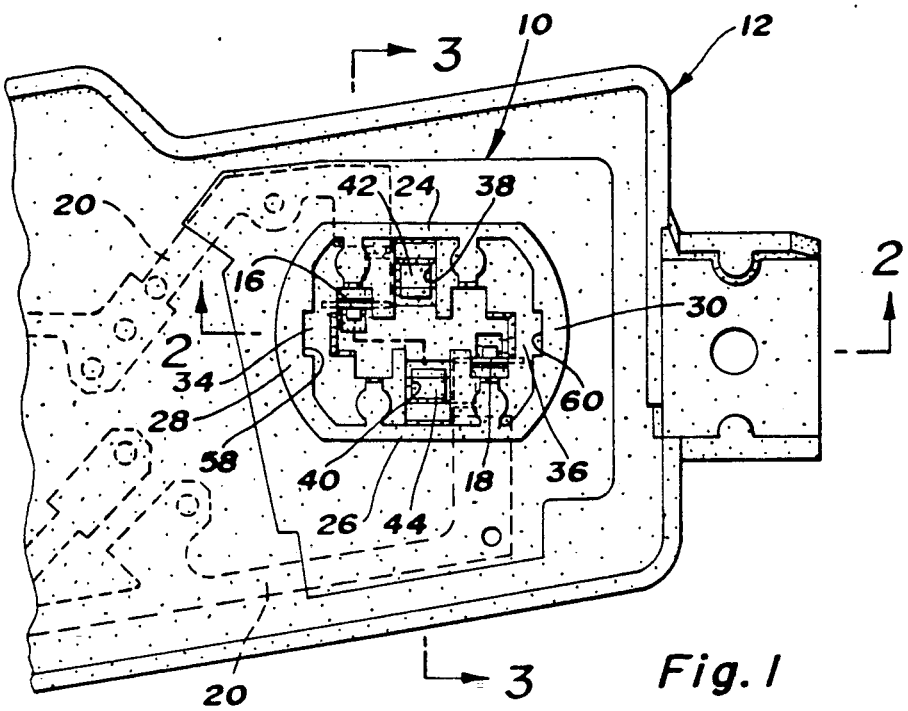
Figure 2:
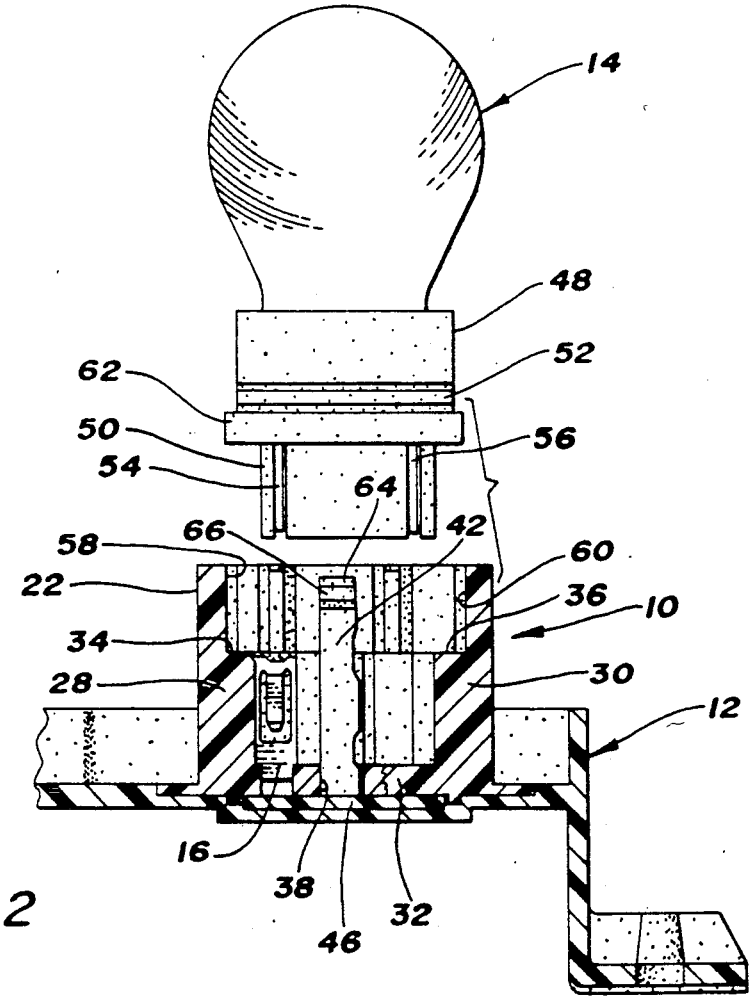
FIG. 2 is a sectional view of the lamp socket assembly taken on line 2—2 of FIG. 1.
Figure 3:
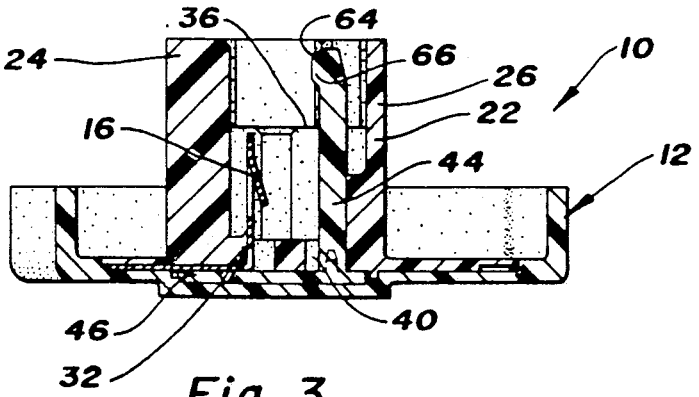
FIG. 3 is a sectional view of the lamp socket assembly taken on line 3—3— of FIG. 1.
Figure 4:
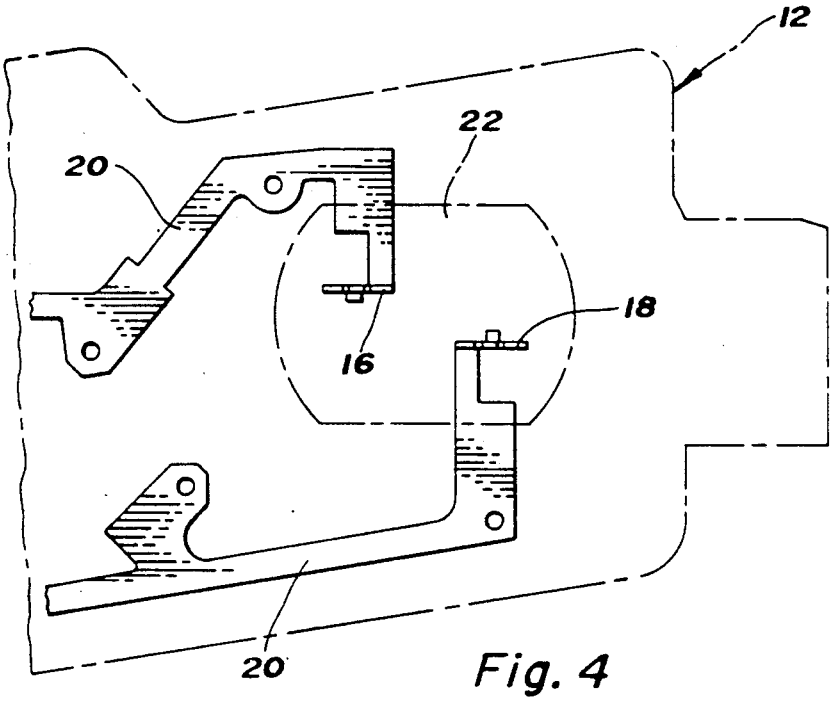
FIG. 4 shows the lead connectors and integral ground terminal and feed terminal relatively positioned prior to having the plastic tubular portion of the lamp socket assembly molded around the terminals.
Figure 5:
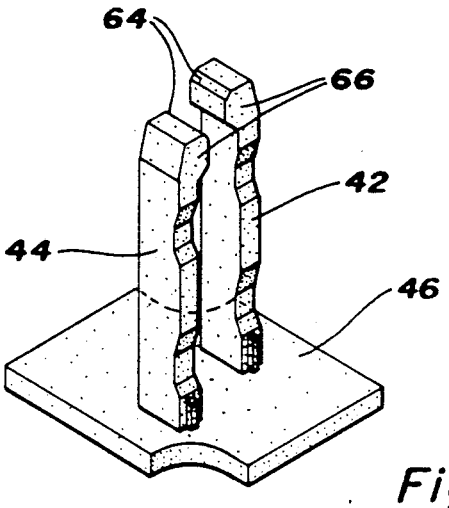
FIG. 5 is a perspective view of an insert having spring arms which serve as latch means for retaining a wedge-type lamp bulb within the opening of the lamp socket assembly.

Referring now to the drawings and more particularly FIGS. 1 through 3 thereof, a lamp socket assembly 10 is shown which is rigidly formed with a mounting bracket 12 adapted to be fastened to a lamp housing such as employed in tail lamp assemblies of a motor vehicle for locating an electrically energizable lamp bulb 14 in a desired axial and rotational position with respect to the optical components of the lamp housing. The mounting bracket 12 forms a part of the rear wall of the lamp housing and the lamp bulb 14 would be one of two or more lamp bulbs positioned with respect to individual parabolic reflectors for projecting light from the lamp housing when the lamp bulb 14 is energized. Although only one end of the mounting bracket 12 is shown with one lamp socket assembly 10, it will be understood that the remaining part of the mounting bracket 12 would have one or more similar lamp socket assemblies which would receive either a single filament lamp bulb or a double filament lamp bulb the latter of which provides a running light and brake light for the vehicle. The major portion of the lamp socket assembly 10 is a plastic part which when molded partially encapsulates a ground terminal 16 and a feed terminal 18 which prior to the molding operation would assume the relative positions seen in FIG. 4. Each of the terminals 16 and 18 is made from an electrically conductive material such as brass and is integrally formed with a lead connector 20.

More specifically, the lamp socket assembly 10 includes a tubular portion 22 which, as seen in FIG. 1, is generally rectangular in configuration having a pair of straight parallel side walls 24 and 26 and a pair of curved end walls 28 and 30 all of which are integral with a bottom wall 32. The side walls 24 and 26 and the end walls 28 and 30 as well as the bottom wall 32 define a stepped cavity with opposed shoulders 34 and 36 as seen in FIG. 2. The cavity is adapted to receive the lamp bulb 14 which is known in the trade as a wedge-base type lamp bulb. Lamp bulbs of this type are identified as No. 2358 and No. 2457, one being a single filament lamp bulb and the other a dual filament lamp bulb.

The bottom wall 32 of the tubular portion 22 of the lamp socket assembly 10 has a pair of identical rectangular openings 38 and 40 one of which is slightly offset from the other. The openings 38 and 40 respectively receive a pair of similarly offset plastic spring arms 42 and 44 the lower ends of each of which are integrally formed with a planar support plate 46. The spring arms 42 and 44 and the support plate 46 together form an insert, and as seen in FIGS. 2 and 3, the spring arms 42 and 44 are adapted to be inserted through the accommodating openings 38 and 40 in the tubular portion 22 for positioning of the spring arms 42 and 44 within the cavity as seen in FIGS. 1 through 3. The support plate 46 can be secured to the bottom wall 32 of the tubular portion 22 by an adhesive or the like and afterwards the composite can be placed in a mold and, using insert molding technology, the mounting bracket 12 can be formed around the support plate 46 and also encapsulate the lead connectors 20 as seen in FIGS. 1 through 3.

In this case, lamp bulb 14 is a single filament wedge-type bulb that includes a base 48 which is rectangular in cross section and has an integrally formed terminal retainer 50 depending therefrom. As is conventional with lamp bulbs of this type, a channel 52, which extends transversely to the longitudinal axis of the lamp bulb 14, is formed on each side of the base 48. Also, as is conventional, the terminal retainer 50 has a pair of terminals 54 and 56 which connect with the filament in the lamp capsule and are adapted to make electrical contact with the feed terminal 18 and the ground terminal 16. In this regard, a pair of opposed slots 58 and 60 formed in the end walls 28 and 30, respectively, of the tubular portion 22 of the lamp socket assembly 10 serve to receive the opposite ends of an enlarged guide section 62 located between the base 48 and retainer 50 so as to assure proper insertion of the lamp bulb 14 into the cavity of the tubular portion 22. During insertion of the lamp bulb 14 into the cavity in the tubular portion 22, the guide section 62 will initially contact a ramp surface 64 on the hook shaped head 66 of each spring arm 42 and 44. As the lamp bulb 14 is pressed into the cavity, the spring arms 42 and 42 will spread apart. When the guide section 62 moves downwardly into the cavity beyond the heads 66, the spring arms, due to the internal elastic forces of the plastic material from which they are made, will flex towards each other and cause the heads 66 to move into the opposed channels 52 of the base 48 and releaseably lock the lamp bulb 14 within the cavity. Thus, the spring arms 42 and 44 serve as latch means for holding the lamp bulb 14 firmly within the cavity.

It is important to note that a lamp socket assembly 10 made according to the invention that provided excellent lamp bulb retention by the spring arms 42 and 44 under all lighting conditions of the lamp bulb 14, had the tubular portion 22 made of a plastic material such as DuPont ZYTEL 70G-33-HSI-L, (Natural #120-00135) and the insert, consisting of the spring arms 42 and 44 and support plate 46, was made from a higher melt temperature plastic material such as LNP-ICI VICTREX D4101-GL30 (Natural #120-00149). Also, in such case the mounting bracket 12 was made of a plastic material identified as LNP THERMOCOMP AF-1006.

Various changes and modifications can be made in the above described construction without departing from the spirit of the invention. Such changes and modifications are contemplate by the inventors and they do not wish to be limited except by the scope of the appended claims.

The embodiments of the invention in which an exclusive property or privilege is claimed are defined as follows:

1. A lamp socket assembly having a tubular portion adapted to be integrally molded with a ground terminal and a feed terminal for electrical engagement with the terminals of a snap-in wedge-type lamp bulb, said wedge-type lamp bulb having a rectangular base integrally formed with an enlarged guide section and a terminal retainer section for supporting said terminals of said wedge-type lamp bulb, said ground terminal and said feed terminal each being formed with a lead connector, said tubular portion being made of a plastic material and having a pair of opposed end walls each of which is formed with a slot for receiving one end of said enlarged guide section for permitting said terminal retainer to be inserted into said tubular portion for causing electrical contact with said ground terminal and said feed terminal, a bottom wall interconnecting said end walls of said tubular portion, an opening formed in said bottom wall, an insert having a pair of spring arms attached to a support plate and adapted to be inserted into said opening for engaging said enlarged guide section and thereby serving to releasably retain said wedge-type lamp bulb within said tubular portion, and means for rigidly securing said support plate to said tubular portion.

2. A lamp socket assembly having a tubular portion adapted to be integrally molded with a ground terminal and a feed terminal for electrical engagement with the terminals of a snap-in wedge-type lamp bulb said wedge-type lamp bulb having a rectangular base integrally formed with an enlarged guide section and a terminal retainer section for supporting said terminals of said wedge-type lamp bulb, said ground terminal and said feed terminal each being formed with a lead connector, said tubular portion being made of a plastic material and having a pair of opposed end walls each of which is formed with a slot for receiving one end of said enlarged guide section for permitting said terminal retainer to be inserted into said tubular portion for causing electrical contact with said ground terminal and said feed terminal, a bottom wall interconnecting said end walls of said tubular portion, an opening formed in said bottom wall, a latch means having a pair of spring arms insertable into said opening for engaging said enlarged guide section and thereby serving to releasably retain said wedge-type lamp bulb within said tubular portion, and a plastic mounting bracket molded around the lead connectors and said bottom wall and serving to rigidly secure said latch means to said tubular portion.

3. A lamp socket assembly having a tubular portion adapted to be integrally molded with a ground terminal and a feed terminal for electrical engagement with the terminals of a snap-in wedge-type lamp bulb said wedge-type lamp bulb having a rectangular base integrally formed with an enlarged guide section and a terminal retainer section for supporting said terminals of said wedge-type lamp bulb, said ground terminal and said feed terminal each being formed with a lead connector, said tubular portion being made of a plastic material and having a pair of opposed end walls each of which is formed with a slot for receiving one end of said enlarged guide section for permitting said terminal retainer to be inserted into said tubular portion for causing electrical contact with said ground terminal and said feed terminal, a bottom wall interconnecting said end walls of said tubular portion, a pair of openings formed in said bottom wall, latch means separate from said tubular portion and having a pair of spring arms inserable into said pair of openings for engaging said enlarged guide section and thereby serving to releasably retain said wedge-type lamp bulb within said tubular portion, said spring arms being integrally formed with a support plate, and a plastic mounting bracket molded around the lead connectors and said bottom wall and serving to rigidly secure said support plate to said tubular portion, said latch means being made of a plastic material having a higher heat resistance tolerance than the heat resistance tolerance of the plastic material of said tubular portion.

* * * * *